US007481964B2

(12) United States Patent
Nichol et al.

(10) Patent No.: US 7,481,964 B2
(45) Date of Patent: Jan. 27, 2009

(54) SEALED IMPELLER FOR PRODUCING METAL FOAM AND SYSTEM AND METHOD THEREFOR

(75) Inventors: Scott Nichol, Etobicoke (CA); Richard G. Manley, Brampton (CA)

(73) Assignee: CYMAT Corp., Mississauga, Ontario (CA)

( * ) Notice: Subject to any disclaimer, the term of this patent is extended or adjusted under 35 U.S.C. 154(b) by 433 days.

(21) Appl. No.: 10/506,594

(22) PCT Filed: Mar. 3, 2003

(86) PCT No.: PCT/CA03/00292

§ 371 (c)(1),
(2), (4) Date: Jun. 14, 2005

(87) PCT Pub. No.: WO03/074163

PCT Pub. Date: Sep. 12, 2003

(65) Prior Publication Data

US 2005/0232761 A1 Oct. 20, 2005

Related U.S. Application Data

(60) Provisional application No. 60/361,281, filed on Mar. 4, 2002.

(51) Int. Cl.

| | |
|---|---|
| ***C21C 7/072*** | (2006.01) |
| ***C22B 9/05*** | (2006.01) |
| *C21C 7/00* | (2006.01) |
| *B22D 27/13* | (2006.01) |

(52) U.S. Cl. ..... 266/217; 266/216; 266/218; 266/235; 266/236; 164/79; 222/603; 75/501; 75/512; 75/602; 75/648; 75/649; 75/680

(58) Field of Classification Search ..... 164/79; 222/603; 266/216–218, 235–236; 75/501, 75/512, 602, 648–649, 680
See application file for complete search history.

(56) References Cited

U.S. PATENT DOCUMENTS 2,336,017 A * 12/1943 Jewell et al. ..... 34/369

(Continued)

FOREIGN PATENT DOCUMENTS

DE 43 26 982 C1 2/1995

(Continued)

OTHER PUBLICATIONS

Leitlmeier, Dietmar & Flankl, Herbert; Process Development and Material Characterization For the Novel Melt Processing of Near Net Shape Foam Parts; ATTCE 2001 Proceedings, vol. 4, Materials (P-370); Automotive & Transportation Technology Congress & Exhibition; Barcelona, Spain, Oct. 1-3, 2001.

(Continued)

*Primary Examiner*—Roy King
*Assistant Examiner*—Lois L. Zheng
(74) *Attorney, Agent, or Firm*—Dorsey & Whitney LLP

(57) ABSTRACT

A system for producing a metal foam comprises a bath containing a molten metal, a rotating shaft or impeller extending through the base of the bath into, and submerged in the molten metal, and a gas discharge nozzle provided on the submerged end of the shaft. The opposite end of the shaft is connected to a gas supply line and the shaft is rotated with a motor. A seal is provided at the opening in the base of the bath for preventing leakage of the molten metal there-through.

10 Claims, 3 Drawing Sheets

U.S. PATENT DOCUMENTS

| | | | |
|---|---|---|---|
| 3,214,265 | A | 10/1965 | Fiedler |
| 3,297,431 | A | 1/1967 | Ridgway, Jr. |
| 3,300,296 | A | 1/1967 | Hardy et al. |
| 3,329,198 | A | 7/1967 | Manning et al. |
| 3,346,033 | A | 10/1967 | Olejniczak |
| 3,367,401 | A | 2/1968 | Bonis et al. |
| 3,689,048 | A | 9/1972 | Foulard et al. |
| 3,843,353 | A | 10/1974 | Niebylski et al. |
| 3,940,262 | A | 2/1976 | Niebylski et al. |
| 4,099,961 | A | 7/1978 | Patten |
| 4,618,427 | A | 10/1986 | Venas |
| 4,850,723 | A | 7/1989 | Whiteman, Jr. |
| 4,860,820 | A | 8/1989 | Pereira |
| 4,875,518 | A | 10/1989 | Imura et al. |
| 5,124,038 | A | 6/1992 | Sekino |
| 5,221,324 | A | 6/1993 | Jin et al. |
| 5,281,251 | A | 1/1994 | Kenny et al. |
| 5,334,236 | A | 8/1994 | Sang et al. |
| 5,622,542 | A | 4/1997 | Thomas et al. |
| 5,865,237 | A | 2/1999 | Schorghuber et al. |
| 6,090,232 | A | 7/2000 | Seeliger et al. |
| 6,146,443 | A | 11/2000 | Eckert |
| 6,209,616 | B1 | 4/2001 | Polich |
| 6,508,977 | B2 | 1/2003 | Eckert et al. |
| 6,840,301 | B2 | 1/2005 | Nichol et al. |
| 2003/0005793 | A1 | 1/2003 | Dobesberger et al. |
| 2003/0047036 | A1 | 3/2003 | Dobesberger et al. |
| 2003/0198827 | A1 | 10/2003 | Dobesberger et al. |
| 2004/0076849 | A1 | 4/2004 | Dobesberger et al. |

FOREIGN PATENT DOCUMENTS

| | | | |
|---|---|---|---|
| EP | 0 483 184 | B1 | 5/1992 |
| EP | 1 127 610 | A3 | 8/2001 |
| EP | 1127610 | A2 | 8/2001 |
| GB | 760561 | | 10/1956 |
| GB | 892934 | A | 4/1962 |
| GB | 901917 | A | 7/1962 |
| WO | WO 91/01387 | A1 | 2/1991 |
| WO | WO 92/21457 | A1 | 12/1992 |
| WO | WO 94/09931 | A1 | 5/1994 |

OTHER PUBLICATIONS

Davies, G.J.; Zhen, Shu; Review Metallic Forms: Their Production Properties and Applications; Journal of Material Science; 1983, pp. 1899-1911, No. 18.

* cited by examiner

SEALED IMPELLER FOR PRODUCING METAL FOAM AND SYSTEM AND METHOD THEREFOR

BACKGROUND OF THE INVENTION

1. Field of the Invention

The present invention relates generally to submerged impellers and, more particularly, to impellers used in generating metal foam.

2. Description of the Prior Art

There is a considerable demand for materials having high strength and low weight characteristics for use in manufacturing various articles. Such materials are very much in demand in the automobile and construction industries. To meet this demand, metal foam has been proposed. Metal foam is generally formed by introducing a gas into a molten metal bath to generate a foam on the surface thereof. Due to its high strength to weight ratio, aluminum is a favoured metal to use in generating a foam, although other metals can also be used. The foam is then removed and formed or cast into the desired shapes. Various methods have been proposed for introducing the gas into the molten metal bath. Such methods include the use of gas generating additives, blowing of air etc. With regard to the latter method, various apparatus and systems are known for blowing a gas into the molten metal. Such apparatus include nozzles, impellers and other such devices.

In U.S. Pat. No. 5,334,236, there is described a metal foam generating system wherein air is introduced by means of a gas nozzle at the end of a supply tube or a hollow rotating impeller having a plurality of openings through which the gas is passed. In both cases, the tube or impeller is mounted on an angle into the metal bath through an opening. There is no teaching in this patent as to how such opening is sealed to prevent the molten metal from leaking. Further, the shafts used in forming the tubes or impellers are formed from stainless steel due to the fact that they are immersed in molten metal. Nevertheless, such shafts are known to become deteriorated after prolonged immersion in the molten metal and must be replaced often. Another deficiency in these known gas introduction systems is that since the shafts are provided in an angled manner into the molten metal bath, the length of the shafts must be adjusted if the depth of the bath is increased. Apart from the drive mechanism requirements of such an arrangement, it will be understood that the cost for each shaft would also be greater. This, compounded with the need for constant replacement of the shafts, results in a light cost of operation.

In U.S. application Ser. No. 60/312,757, sharing a common inventor with the present application, an improved metal foam generating and casting system is provided. In this system, a metal foam is generated by introducing a gas into the bottom of the metal bath to generate bubbles. The bubbles are then allowed to rise through a riser tube connected to a die cavity. The bubbles then form a foam inside the cavity. After the cavity is filled, it is allowed to cool and the formed metal foam article is retrieved. In this case, the generation of bubbles at a specific location is desired. This reference provides a porous nozzle located at the bottom of the molten metal bath, positioned generally directly under the riser tube. Although such porous nozzle results in the desired foam generation, a rotating nozzle is believed to improve the foam characteristics. However, the rotating nozzle shafts known in the art have various disadvantages as described above. In this specific application, one other disadvantage is that, with angled impeller shafts, it is often not possible to ensure that the formed bubbles are introduced into the riser tube. Further, the above mentioned system involves the pressurization of the foaming chamber. In such case an adequate seal around the impeller is needed in order to prevent leakage. Such seal is difficult to establish in situations where the impeller is introduced through the side of the molten metal bath.

Thus, there exists a need for an improved impeller system for generating metal foam.

SUMMARY OF THE INVENTION

Thus, in one embodiment, the present invention provides a submerged gas discharge impeller for supplying a gas to liquid within a container, said impeller comprising:

- a hollow shaft having at least one bore and a first end connected to a gas supply and a second end extending into said liquid through an opening in the bottom of said container;
- the second end of said shaft including a gas discharge nozzle in fluid communication with said bore;
- the shaft including a seal for preventing leakage of said fluid;
- a drive means for rotating the shaft about its longitudinal axis.

In another embodiment, the invention provides a system for discharging a gas through a liquid, the system comprising:

- a container for said liquid, said container having a base with an opening;
- a hollow shaft having a first end connected to a gas supply and a second end extending into said liquid through said opening in said container;
- a gas discharge nozzle connected to said second end of said shaft;
- a seal provided adjacent said opening in said container for preventing leakage of said liquid;
- a motor connected to said shaft for rotating said shaft about its longitudinal axis.

In yet another embodiment, the invention provides a system for producing a metal foam from a molten metal comprising:

- a bath containing said molten metal, said bath comprising a container with an opening on the base thereof;
- a hollow, rotatable shaft extending generally vertically into said molten metal through said opening, said shaft including a first end extending into said molten metal and a second end connected to a gas supply;
- the first end of said shaft including a gas discharge nozzle submerged in said molten metal;
- a seal located between said shaft and said opening for preventing passage of said molten metal;
- a drive mechanism connected to said shaft for rotating said shaft about its longitudinal axis.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
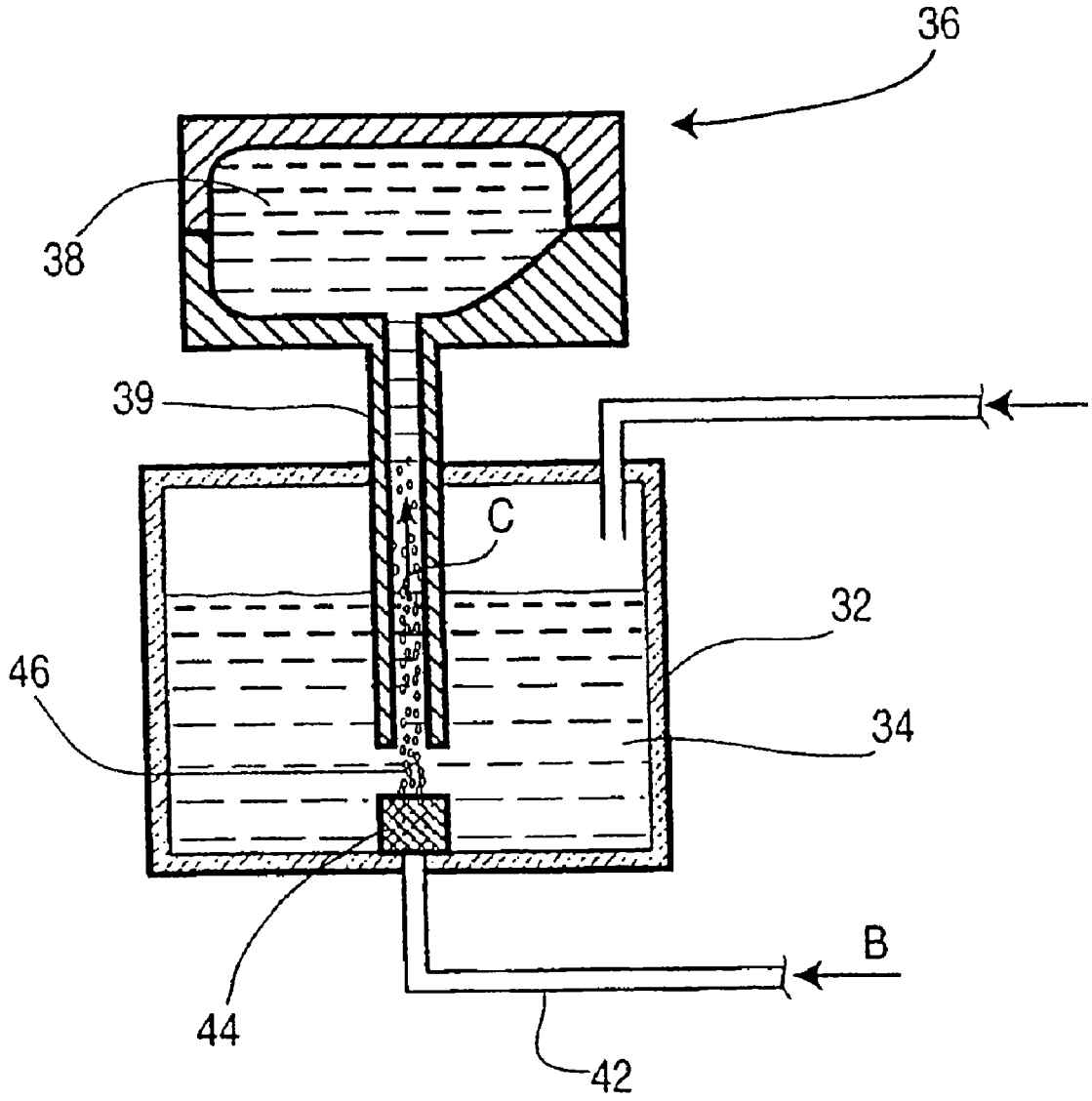
FIG. 1 is a cross sectional elevation of a metal foam casting apparatus.

FIG. 1 illustrates a metal foam casting system as taught in U.S. application Ser. No. 60/312,757, described above, in which the present invention can be used. As illustrated, the casting system includes a die 36 having a die cavity 38, which is fluidly connected to a riser tube 39. The riser tube 39 extends into a bath 32 containing a molten metal 34. The bath 32 also includes, at the base thereof, a porous plug, or nozzle, 44. A gas supply line 42, connected to the nozzle 44, introduces a gas through the nozzle 44, into the molten metal 34. Such gas leads to the formation of bubbles 46 which, due to their buoyancy, preferentially rise in the direction shown by the arrow C. As can be seen, by positioning the riser tube 39 generally directly over the nozzle 44, the bubbles are caused to enter such tube and rise to form a metal foam. As will be appreciated the opening of the tube 39 may be provided with a funnel shaped end to assist in collecting the formed bubbles. The foam is, thereby, allowed to enter and fill the die cavity 38. As will be understood by persons skilled in the art, once the die cavity is filled with the metal foam, the die can be cooled to solidify the foam and, subsequently, remove the formed foam article.

Figure 2:
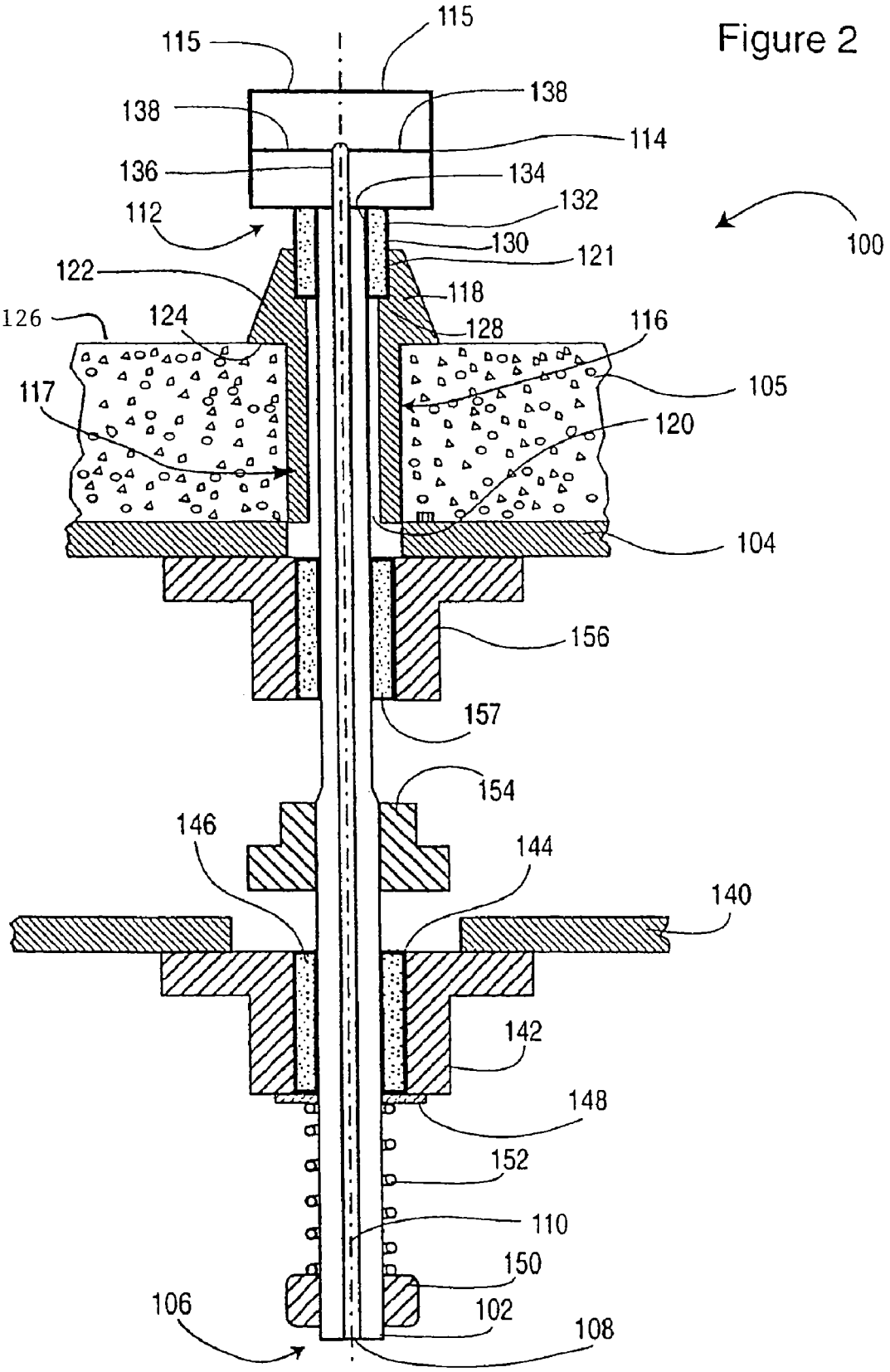
FIG. 2 is a cross sectional elevation of a detail of molten metal bath illustrating an impeller according to an embodiment of the present invention.

FIG. 2 illustrates a rotating gas supply impeller for use, in one example, as an alternative to the stationary porous nozzle of the metal foam casting system described above and as illustrated in FIG. 1.

The rotating impeller according to one embodiment of the invention is shown generally at 100 in FIG. 2. The impeller includes a hollow shaft 102 that extends generally vertically into the base 104 of the molten metal bath (not shown). As is commonly shown in the art, the bath, including the base 104, is provided with a refractory or insulating material 105 that is capable of withstanding the temperatures of the molten metal. A first, bottom end 106 of the shaft 102 provides and exposed opening 108 into the hollow bore 110 of the shaft 102. Air is introduced into the bore 110 of the shaft 102 by connecting a gas supply line (discussed further below) to the opening 108.

Figure 3:
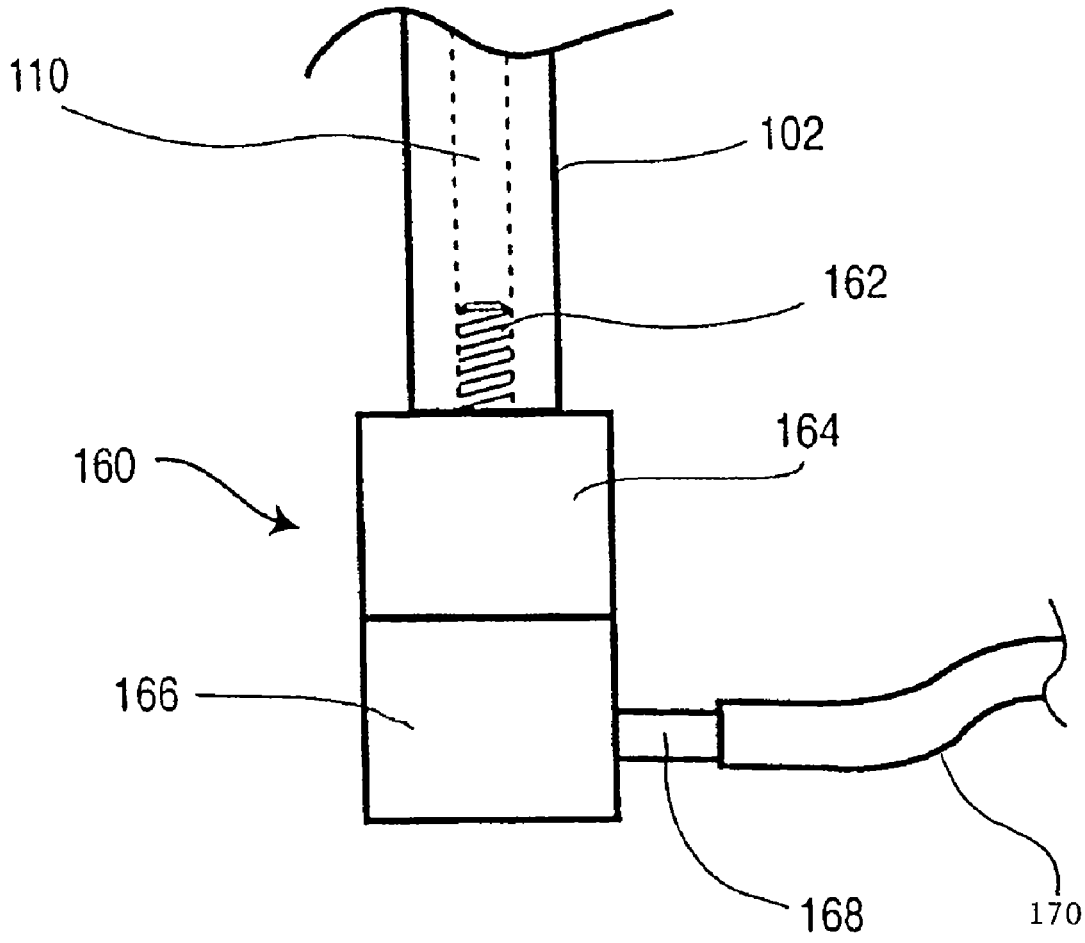
FIG. 3 is a side view of a gas supply mechanism for the impeller of the invention.

Turning briefly to FIG. 3, an example of a gas supply arrangement is illustrated. As shown, the shaft 102 includes a threaded portion (not shown) on the interior wall of the bore 110. A rotary union 160 includes a threaded connector 162 having a thread that is complementary to that of the bore 110. The rotary union 160 is secured to the shaft 102 by screwing the connector 162 into to the bore 110. The rotary union 160 includes a rotating section 164 and a stationary section 166. The means of linking sections 164 and 166 together is commonly known and, indeed, the rotary union 160 itself is commercially available. A gas supply port 168 is provided on stationary section 166. A gas supply line 170 is then attached to the supply port 168. Although preferred gas supply system has been described, various other methods of providing a gas supply to the shaft 102 will be apparent to persons skilled in the art.

Returning to FIG. 2, on the second, top end 112 of the shaft 102, there is attached a gas outlet nozzle 114. The top end 112 of the shaft 102 extends into the molten metal bath through an opening 116, which extends through the base 104 and refractory material 105. A support 118 having a central bore 120 is provided in the opening 116 in the base 104. The shaft 102 extends through the central bore 120 of the support 118, with the central bore 120 being dimensioned to allow free rotation of the shaft 102. The support 118 includes a generally conical upper portion 122, which includes an annular shoulder 124 that bears against a portion the inner surface 126 of the base 104 or insulating material 105, such portion being adjacent to the opening 116. The support 118 also includes a generally cylindrical body 117, through which extends the bore 120, the body 117 preferably extending through the opening 116. The outer diameter of the body 117 is preferably dimensioned to provide a snug fit within the opening 116. As indicated above, the upper portion 122 of the support 118 has a generally conical structure. Such structure aids in directing molten metal away from the shaft 102. Although the support 118 and the opening 116 are described in terms of preferred structural configurations, it will be understood by persons skilled in the art that various other geometries are possible within the scope of the present invention as described herein. It will also be understood that the support 118 is preferably made from a material that is capable of withstanding the temperature of the molten metal. For example, suitable materials include alumina silicate, graphite or ceramics.

The central bore 120 of support 118 includes an upper region 121, at the top end of the support 118, which has a larger diameter than that of the bore 120. Such widened diameter provides a ledge 128, which supports a seal or bushing 130. The bushing 130 has a generally cylindrical outer wall 132 that corresponds generally to the diameter of the upper region 121 of the support 118. In the preferred embodiment, the bushing 130 is maintained in position within the upper region 121 by frictional contact between its outer wall 132 and the inner wall of the upper region 121. Further, such arrangement ensures a tight seal between the bushing 130 and the support 118. In the preferred embodiment, the bushing 130 is made of graphite to withstand the temperatures of the molten metal to which it is exposed. However, other materials will be apparent to persons skilled in the art such as ceramics, metals, or composites. Some examples of possible materials for the bushing 130 include, inter alia, graphite, titanium diboride, tungsten, alumina, zirconium oxide ($ZrO_2$), silicon carbide, silicon nitrate, boron nitrate, titanium carbide and tungsten carbide.

In another embodiment, the support 118 can be integrally formed with the seal or bushing 130. However, it will be understood that a separate seal is preferred so as to facilitate replacement as the seal 130 wears out. It will also be understood that for forming an optimal seal, the underside of the nozzle 114 should be square with the upper contacting surface of the seal or bushing 130.

In a preferred embodiment, the material chosen for the seal or bushing 130 is non-wetted by the molten metal. Similarly, the impeller or parts thereof is also made of a non-wetted material. In another embodiment, the elements in contact with the molten metal, i.e. the seal bushing 130, the support 118, the nozzle 114, and any other parts of the impeller, may be coated with a protective material that resists wetting by the molten metal and/or to seal the apparatus to prevent leakage.

The bushing 130 also includes a central bore 134, which accommodates the upper end of the shaft 102 and allow for rotation of the shaft therein. The clearance between the outer diameter of the shaft 102 and the bore 134 of the bushing 130 is preferably maintained as minimal as possible so as to provide a sealing arrangement there-between. In this manner, and with the seal between the bushing 130 and the support 118, leakage of molten metal within the bath is prevented.

The gas discharge nozzle 114 preferably comprises a generally cylindrical body secured to the top end of the shaft. In the preferred embodiment, the body of the nozzle 114 comprises a plurality of fins 115 extending radially from the central axis of the body. The nozzle 114 also includes a central opening 136 in fluid communication with the central bore 108 of the shaft 102. In the preferred embodiment, the opening 136 does not extend through the entire body of the nozzle 114 and, instead, the body of the nozzle 114 is provided with one or more, and more preferably, a plurality of gas discharge vents 138 extending through the fins 115. The vents 138 radiate from, and are in fluid communication with, the opening 136 of the nozzle 114. The vents 138 open into the molten metal bath so as to discharge the gas supplied through the shaft 102 into the molten metal. By securing the nozzle 114 to the shaft 102, it will be understood that rotation of the shaft 102 also results in the rotation of the nozzle. In the preferred embodiment, the bottom surface of the nozzle 114 abuts the top surface of the bushing 130 so as to establish a sealing arrangement there-between.

The shaft 102 extends through an opening in a stationary support 140 located below the bath. The support 140 preferably includes a bearing 142 having a central bore 144 that is greater in diameter than that of the shaft 102. The bore 144 is preferably provided with a bushing 146 through which is passed the shaft 102. It will be understood that the shaft 102 is rotatably accommodated within the bushing 146. One of the purposes of the bearing 142 is, as will be understood, to support and stabilize the shaft 102 while it is rotated. The bearing 142 is preferably also provided with a washer 148 on the bottom thereof, through which is passed the shaft 102. The purpose of the washer 148 is described below.

At the bottom end 106 of the shaft 102, there is provided a collar 150, secured to the shaft. Between the collar 150 and the washer 148, there is provided a spring 152, the spring being in a compressed state. As will be understood, the spring, being provided in this manner, exerts a force bearing against the washer 148 and the collar 150, causing the washer and the collar to be forced away from each other. This force will extend along the length of the shaft 102 thereby causing the bottom surface of the nozzle 114 to bear against the top surface of the bushing 130, thereby serving to strengthen the seal between the nozzle and the bushing to prevent leakage of molten metal from the bath. It will also be understood that such force will also ensure that the support 118 is pressed against the inner surface of the bath to ensure a seal there-between as well. It will be appreciated, however, that the primary reason for applying a force by means of the spring 152 is to seal the nozzle against the bushing. Although the use of a spring 152 is a preferred method of achieving the desired seal, it will be understood that any other means may also be employed. For example, the shaft 102 may be attached to any other force applying means to achieve the desired result. Alternatively, the weight of the shaft and associated elements may be sufficient to provide the necessary sealing force.

The present invention envisages various means of rotating the shaft 102. In one embodiment, the shaft 102 is provided with a pulley 154, secured to the shaft 102 in a location along the length thereof. The pulley 154 translates a drive force applied thereto into axial rotation of the shaft 102. As is known in the art, the pulley 154 is adapted to engage a drive belt that is connected to a drive motor (not shown). In another embodiment, the pulley 154 may be replaced with a sprocket that engages a cooperating sprocket on a drive shaft of a motor. The choice drive means for axially rotating the shaft 102 will depend upon the drive mechanism being used. It will also be understood that locating the drive means (for example the pulley 154) away from the bottom end 106 of the shaft 102 is preferred so as not to interfere with the gas supply line feeding the bore 108.

In the preferred embodiment, a further bearing 156 is provided on the underside of the base 104 of the bath. The bearing 156 can be, for example, of the same structure as bearing 142 described above. It will be understood that the purpose of the bearing 156 is to support and stabilize the shaft 102 while it is rotated. It will also be understood that in other embodiments of the invention, the bearing 156 may not be needed if the shaft 102 is able to support itself. As shown, in the preferred embodiment of the invention, the bearing 156 is also provided with a bushing 157 similar to bushing 146. It will also be appreciated that any number of bearings or bushings can be used depending upon the needs of the apparatus.

As described above, an impeller according to the present invention improves the dispersal of the gas discharged within the molten metal. Also, the impeller of the invention, by minimizing or eliminating the length of the shaft exposed to the molten metal, avoids damage thereto as described above as well as other deleterious effects of having a rotating shaft within the fluid molten metal. Also, by providing a means of discharging gas directly from the bottom of the bath, the desired vertical rise of the gas bubbles is achieved.

In the above described embodiments, a system having a single impeller shaft and gas discharge nozzle has been described. However, the invention also contemplates other systems wherein several impellers and nozzles are employed. As will be apparent to persons skilled in the art, more than one impeller and nozzle combination may be more efficient when large diameter riser tubes 39 are used.

The present invention has been described in terms of its use in a metal foam casting system. However, it will be appreciated that this is only one possible use of the invention and that various other uses are within the scope thereof. Although impeller speeds of around 4500 rpm are known in art of metal foam generation, any other desired speed would, of course, be possible.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A gas discharge impeller for supplying a gas to a molten metal within a container, said impeller comprising:

a rotatable hollow shaft having a bore, a first end connected to a gas supply and a second end extending upwardly into said container through an opening in the bottom of said container;

the second end of said shaft including a gas discharge nozzle in fluid communication with said bore, the nozzle being adapted to be submersed in said molten metal when in use; and a drive means for rotating the shaft about its longitudinal axis; characterised in that:

the rotatable shaft includes a seal for preventing leakage of said fluid through said opening in the container bottom, said seal being in direct sealing engagement with said rotatable shaft and said container to form a liquid seal there-between; and wherein said seal comprises a generally annular support and a generally annular bushing, said support including a lower portion extending through said container opening and an upper portion extending into said container, the support upper portion including a support surface to support said bushing and wherein said support and bushing are coaxially provided around the circumference of said shaft second end and wherein said bushing sealingly engages said shaft circumference.

2. The impeller of claim 1 further including a means for urging said shaft downwardly against said seal for forming a sealing engagement with said container bottom.

3. The impeller of claim 1 wherein said support upper portion further includes an outwardly flared shoulder, said shoulder being wider than the container opening for sealingly engaging said container.

4. The impeller of claim 3 wherein said support upper portion has a generally conical outer surface.

5. The impeller of claim 4 wherein said means for urging comprises a spring.

6. The impeller of claim 5 wherein said shaft is provided with at least one bearing beneath the container.

7. The impeller of claim 6 wherein the bushing and support are formed from materials chosen from the group consisting of ceramics; carbides; graphite; titanium diboride; tungsten; alumina; zirconium oxide; silicon carbide; silicon nitrate; boron nitrate; titanium carbide; and tungsten carbide.

8. The impeller of claim 7 wherein portions of said impeller exposed to said molten metal are formed of a material that repels said molten metal.

9. The impeller of claim 7 wherein portions of said impeller exposed to said molten metal are coated with a material that repels said molten metal.

10. A system for producing a metal foam from a molten metal comprising:

a container containing said molten metal, said container having an opening in the bottom thereof; and the impeller according to claim 1.

* * * * *